United States Patent [19]

Scherer

[11] 4,440,181

[45] Apr. 3, 1984

[54] NAIL POLISH REMOVER KIT

[76] Inventor: John S. Scherer, 1123 Kings Cove Dr., Rochester, Mich. 48063

[21] Appl. No.: 275,114

[22] Filed: Jun. 18, 1981

Related U.S. Application Data

[63] Continuation-in-part of Ser. No. 222,357, Jan. 5, 1981, abandoned.

[51] Int. Cl.[3] ..... A45D 29/18

[52] U.S. Cl. ..... 132/73.5; 132/75; 401/122

[58] Field of Search ..... 132/73, 73.5, 75; 401/7, 198, 130

[56] References Cited

U.S. PATENT DOCUMENTS

| | | | |
|---|---|---|---|
| 63,941 | 4/1867 | Bly . | |
| 1,115,597 | 11/1914 | Sherman . | |
| 1,652,875 | 12/1927 | Rein et al. . | |
| 1,753,044 | 4/1930 | Culver . | |
| 2,101,598 | 12/1937 | Riedel | 215/355 |
| 2,148,736 | 2/1939 | Engler . | |
| 2,258,030 | 10/1941 | Oxleeg . | |
| 2,524,681 | 10/1950 | Roosa . | |
| 2,601,557 | 6/1952 | Ragusa . | |
| 2,621,356 | 12/1952 | Ingraham . | |
| 2,627,619 | 2/1953 | Gagen . | |
| 2,644,183 | 7/1953 | Kellett . | |
| 2,703,422 | 3/1955 | Roosa . | |
| 2,703,898 | 3/1955 | Kellett . | |
| 2,785,692 | 3/1957 | Gordon . | |
| 2,962,743 | 12/1960 | Hendriksson et al. . | |
| 2,983,938 | 5/1961 | Veazy . | |
| 3,033,213 | 5/1962 | Joss et al. . | |
| 3,056,998 | 10/1962 | Ebner . | |
| 3,067,450 | 12/1962 | Mirth . | |
| 3,132,653 | 5/1964 | Gazdih . | |
| 3,146,806 | 9/1964 | Ginsburg | 401/122 |
| 3,214,782 | 11/1965 | Masters et al. . | |
| 3,223,272 | 12/1965 | Vernon . | |
| 3,224,029 | 12/1965 | Domingos . | |
| 3,298,054 | 1/1967 | Humble . | |
| 3,372,424 | 3/1968 | Kellett . | |
| 3,415,604 | 12/1968 | Ahrens et al. . | |
| 3,460,702 | 8/1969 | Andrews . | |
| 3,469,928 | 9/1969 | Widegren . | |
| 3,938,686 | 2/1976 | Milligan . | |
| 4,022,228 | 5/1977 | Ropp . | |
| 4,118,821 | 10/1978 | Kuhn . | |
| 4,226,333 | 10/1980 | Percarpio . | |
| 4,255,826 | 3/1981 | Boyd . | |
| 4,282,891 | 8/1981 | Duceppe | 132/73.5 |

FOREIGN PATENT DOCUMENTS

| | | |
|---|---|---|
| 62928 | of 0000 | Fed. Rep. of Germany . |
| 343774 | 3/1931 | United Kingdom . |
| 833581 | 4/1960 | United Kingdom . |
| 940821 | 11/1963 | United Kingdom . |
| 1110824 | 4/1968 | United Kingdom . |

*Primary Examiner*—C. Fred Rosenbaum
*Assistant Examiner*—Sherri Vinyard
*Attorney, Agent, or Firm*—Burton, Parker & Schramm

[57] ABSTRACT

The invention is a nail polish remover kit for removing nail polish from fingers and toenails. The kit has a pear-shaped jar containing a nail polish remover saturated filler. The filler is constricted at the top by the constricted upper portion of the jar to prevent both rotation of the filler and visual sighting of the sludge at the bottom of the jar, produced by nail polish removal process. The filler possesses an opening for inserting a finger having a nail from which polish is to be removed. The opening may be formed from filler surfaces which are smooth or uneven, and, if uneven, preferably corrugated. The opening is dimensioned so that excess nail polish remover is wiped from the finger as it is removed from the filler. The kit also contains a dauber with an absorbent end that the filler opening is designed to receive. This dauber may be removed from the filler to remove polish from toenails, fingernails, and the like.

18 Claims, 7 Drawing Figures

NAIL POLISH REMOVER KIT

DESCRIPTION

This is a continuation-in-part of U.S. Pat. Application Ser. No. 06/222,357, filed Jan. 5, 1981, now abandoned.

FIELD OF THE INVENTION

This invention relates to a nail polish remover kit, and specifically to a kit which may be employed for removing nail polish by inserting the nail from which the polish is to be removed into the kit.

BACKGROUND OF THE INVENTION

The nail polish removal kits known in the prior art have design deficiencies. For example, the closure systems leak so that the nail polish removal solvents tend to evaporate. This results in unnecessary and relatively rapid evaporation of the contents from the kit so that the useful life of the kit is necessarily and prematurely shortened. The containers utilized by the kits tend to be designed so that their contents spill easily. This is especially true of the straight sided containers. Other design defects include using container wall materials through which the nail polish removal solvent could evaporate at an unacceptable rate; the user of foam inside the containers in an excessively loose manner; and the lack of means for removing polish from toenails as well as from the fingers.

SUMMARY OF THE INVENTION

The present invention utilizes a sponge-like filler in a jar having an upwardly opening constricted mouth. This filler, which is saturated with the nail polish remover solution, contains a centered vertical opening for receiving a finger. The opening is narrower than the finger, but expands as the finger is inserted because the sponge-like filler is compressed by the force of the finger being inserted. While inside this solution-saturated filler, the polished nail comes in intimate contact with the nail polish remover solution. The solution removes the polish from the nail, and the solution itself is wiped from the inserted finger and nail, as it is being removed from the jar by the compressed absorbent filler. The surfaces of the finger receiving opening may be uneven or smooth. Preferably, the uneven surfaces will be corrugated surfaces so the surfaces of the finger receiving opening may be considered to be corrugated, noncorrugated, or a combination of the two. In these cases, movement of the polished nail across the undulating surface created by the corrugations has also been found to effectuate nail polish removal via a wiping action.

Thus this invention comprises a jar having an upwardly opening constricted mouth; a lid for removably sealingly closing the mouth; a spongelike filler in the jar having its upper end compressed inwardly by the constricted mouth and thereby retained against upward withdrawal from the jar; said filler having a centrally arranged, downwardly extending, finger receiving opening of a diameter to wipe a finger inserted therein; and a nail polish remover solution in the jar saturating the filler to wet the nail of a finger inserted in said opening.

DESCRIPTION OF PREFERRED EMBODIMENTS

Figure 1:
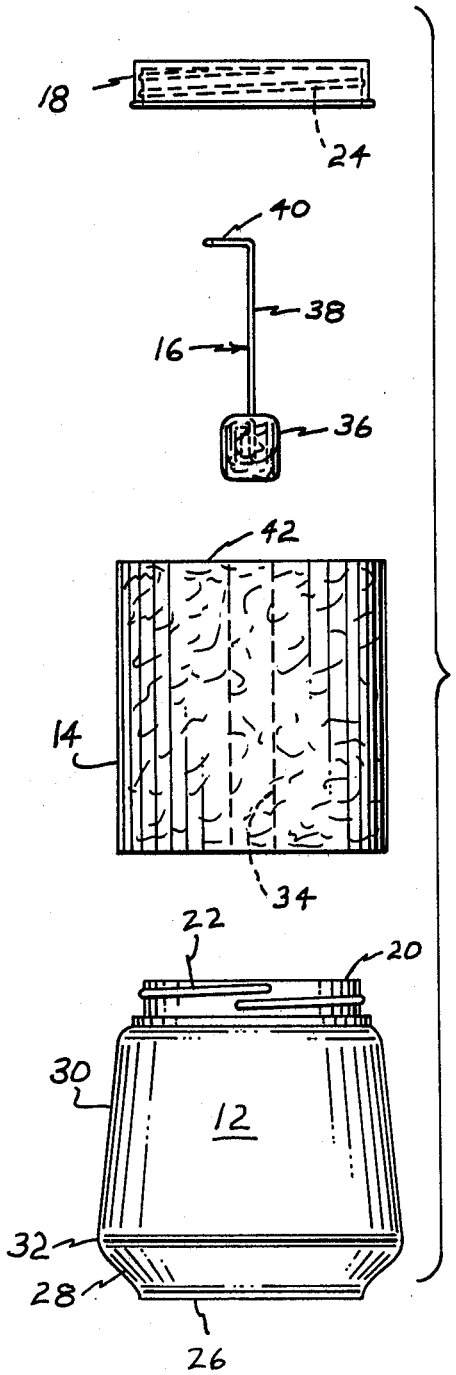
FIG. 1 is an exploded side view of the nail polish remover kit, which separately shows the cover, the dauber, the filler and the jar.

As shown in FIG. 1, the kit comprises a jar 12, a sponge-like filler 14, a dauber 16, a lid 18 and a nail polish remover solution which is not shown, since it saturates the filler 14.

The jar has an upwardly opening constricted mouth 20, the outer diameter of which has been threaded at 22 for cooperating with internal threads 24 in the lid. Preferably the jar 12 should be generally pear-shaped having a flat bottom 26, an integral side wall tapering or diverging outwardly upwardly as at 28 for a short distance and thereafter tapering or converging upwardly as at 30 to the mouth 20. Preferably the jar is manufactured from polypropylene, since other materials which have been tested did not prove to be as satisfactory. For example, glass presented a breakage and shipping weight problem, while both polystyrene and polyethylene allowed the nail polish removal solution to evaporate through the jar walls. Furthermore, the polystyrene and ethylene did not appear to be as resistant to attack by the solution. The preferred jar is 3 3/16 inches in height and the base 26 has a diameter of $2\frac{1}{8}$inches. At the major diameter 32 the jar is approximately $2\frac{3}{4}$inches and the mouth is approximately two inches I.D. The threaded mouth is adapted to engagingly seal with the compatibly threaded 50 mm. polyethylene cap with an Owens-Illinois F217 liner, characterized by being a co-extrusion of low density solid polyethylene-foamed polyethylenelow density solid polyethylene sandwich. A solid white polypropylene jar is preferred. Although this jar is labeled a nine-ounce jar, it actually holds 9.3 ounces of fluid when filled to the bim. However, it is preferred that in actual operation that only eight fluid ounces be used to fill the jar. This pear-shaped jar was chosen not only for aesthetic appeal, but also because of the compression effect it has on the upper portion of the sponge-like filler 14.

The sponge-like filler should have a diameter larger than the jar opening and smaller than the I.D. of the jar at major diameter 32, and should be tall enough so that its uppermost portion is constricted by the upper portion of the jar into which the filler is inserted. Preferably the filler 14 is cylindrical and possesses a centrally arranged, downwardly extending, finger receiving opening 34 with a diameter smaller than that of a finger so as to allow a finger inserted therein to come in contact with nail polish removing solution while wiping the excess liquid from the inserted finger as it is removed. The finger-receiving opening of the filler can be a slot, but should preferably be cylindrical.

The constriction of the sponge-like filler created by the mouth of the jar serves two purposes. One, it serves to hold the filler in place as the finger is inserted and removed. Second, it reduces sideways motion of the filler at the mouth of the jar, thereby eliminating the unsightly view of nail polish sludge, which is a product of the nail polish removal process, that collects at the lower portion of the jar. Furthermore, the constriction serves to increase the capillarity of the filler, improving wetting of the filler in the area of finger insertion and enhancing the separation of the sludge-like product from the nail polish remover solution.

Although the filler used forms a cylinder with a diameter greater than that of the jar's mouth but less than the major diameter of the jar, when acetone is used as a nail polish remover solvent, the acetone causes the filler to expand to fill the jar completely. It is believed that this swelling results in a compression of the filler 14 in the area bounded by the major diameter 32 and the base of the jar. This lower region of compression serves to enhance the nonslippage properties of the filler effected by compression at the jar's mouth. The net effect is to provide a kit which allows contact of nail polish remover solution with the polished nail, removal of the polish, wiping of the polish remover and polish from the finger and/or nail, while hiding from view the aesthetically objectionable sludge which builds up in the lower portion of the jar.

The filler should be made from a material that is relatively resistant to the deterioration commonly caused by contact with nail polish removal solvents such as acetone or acetone -water mixtures. Polyester sponge or foam is a preferred material. Generally 1.4 lb. to 2.0 lb. polyester may be used but 1.8 lb. polyester is preferred.

For the preferred nine-ounce jar the filler should be approximately 2¾inches in height and have a diameter of approximately 2½inches. The centered finger accepting opening 34 should preferably be circular and should have a diameter ranging from ¼ inch to ½ inch. These diameters are chosen since they are smaller than the diameter of a finger, yet large enough to allow easy insertion and retraction.

Figure 2:
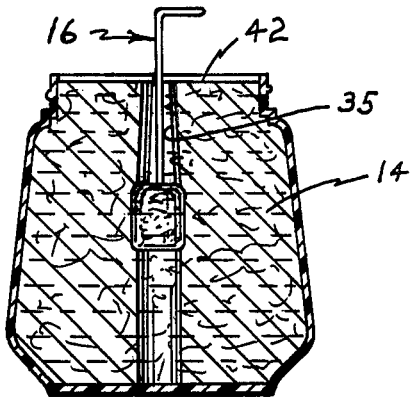
FIG. 2 is a sectional view of the kit with the lid removed.

Although in its uncompressed state the filler 14 generally forms a cylinder, a cylindrical shape is not necessary. The primary reqirements are that the filler be constricted somewhere along its length to retard rotation of the filler or distortion of the filler to expose the sludge line at the bottom of the jar. Preferably the constriction should be found near or at the top of the jar, since the constriction near the top would most effectively satisfy the goals stated. Furthermore, it is preferred that the filler be large enough to completely fill the interior of the jar when filled with nail polish remover solution. The radial compression on the filler 14 caused by the constricted mouth 20 will in turn cause a constriction of the opening 34 as at 35 as best shown in FIG. 2. This serves to enhance the wiping action of the fingernail as the fingertip is inserted and removed from the opening 34.

Although capillarity is increased by the constriction at the jar's mouth, the lower one-half of the jar is the area where most of the actual nail cleaning takes place, and contains the maximum volume of solvent relative to the upper half of the jar.

FIGS. 4–7 depict an alternative embodiment of the invention having a finger receiving opening 34 formed from surfaces 48 having a relatively smooth component 45 and an uneven or corrugated component 46. The smooth component 45 may be clearly seen in FIG. 5 and the corrugated component more clearly seen in FIGS. 4 and 7. The undulations created by the corrugations on an opening surface 48 increase the surface area available for wiping the nail which wiping preferably will be across the corrugations. Of course, the corrugated component 46 need not be present, and if present may be present as one or more components of the dauber opening 45. Alternatively, the finger receiving opening 34 may have only the smooth component 45 or it may have only the corrugated surface opening component 46. A laterally corrugated surface shall be defined as a surface in which the troughs of the corrugations run in an esentially vertical direction, while a vertically corrugated surface shall be defined as a corrugated surface in which the troughs run in an essentially horizontal direction.

Although laterally corrugated surfaces are preferred, vertically corrugated surfaces, or even other arrangements of corrugated surfaces, would also be effective. However, it is felt that the laterally corrugated surfaces would be more effective.

The dauber 16 may be stored in the finger opening 34. The dauber comprises an absorbent end or knob 36 roughly the thickness of a finger. This absorbent end is mounted on a handle 38 which includes an angled portion 40 at the top. The handle is long enough to extend the absorbent end 36 down into the filler opening 34, but not long enough to allow the absorbent end to contact the sludge at the bottom of the jar; and the upper portion 40 of the vertical handle rests upon the upper surface 42 of the filler 14 when the dauber is fully inserted so that the dauber may be easily grasped by the user and retracted or inserted into the filler. Preferably the absorbent end 36 of the dauber will be made of wool, since wool fibers appear to have desirable qualities of absorbency for transferring nail polish remover solution to areas where the nail polish is to be removed, while having sufficient abrasiveness to facilitate nail polish removal, even though the absorbent end itself appears to be smooth, soft and non-abrasive. Furthermore, the wool fibers stand up well to the nail polish remover solvent and the friction it experiences when used on nails and inserted and removed from the filler.

The preferred dauber for the nine-ounce jar which contains eight ounces of fluid should be 2⅜inches long, while the dauber or the absorbent end itself should be ⅝ inches long. The primary concern with length is to extend the absorbent end as far as possible into the jar while leaving sufficient clearance to avoid contamination with the sludge, formed from the nail polish, collected at the bottom of the jar.

The handle may be made fom any material which can withstand chemical attack by the chemicals found in the nail polish remover kit, such as the nail polish remover solvent and the nail polish chemicals themselves. Although galvanized steel has been used, stainless steel is preferred, since it appears to hold up better under conditions of use.

Besides being resistant to chemical attack, the material of the dauber handle should be sufficiently strong to withstand the shear forces created during use; and yet the material should be sufficiently rigid to allow the dauber to be used without annoying flex. For this reason, also, galvanized steel and stainless steel have been found to be the preferred materials. The handle 38 may be attached to the knob 36 in any convenient fashion as by being wrapped tightly about the knob.

The nail polish remover should be a solvent which will soften and/or dissolve commercially available nail polish that is typically used. Solvents such as methyl ethyl ketone, acetone, and the like, have been used. However, acetone is the preferred solvent for this invention.

The most preferred nail polish removal solution contained 86% acetone and 14% water, though more acetone, up to 100%, may be utilized. The addition of water reduces the tendency of the acetone to evaporate, thereby increasing shelf life. Furthermore, this particular concentration of 86% acetone and 14% water was found to be optimum since it removed the polish quickly without damaging the skin, cuticle, or nail; since it allowed the solvent to evaporate rapidly from the finger when withdrawn from the saturated filler; and since that particular concentration of acetone and water did not leave any noticeable residue on the finger after drying. Additionally, this mixture proves to have acceptable toxicity, flammability, odor, and evaporation properties. Higher concentrations of water result in puddling of liquid on the nail while lower concentrations don't noticeably enhance nail polish removal. In addition to nail polish remover solvents such as acetone-water, other additives may be used. For example, lanolins may be added such as isopropylan, fragrances may be added, and dyes may be used. These additives are not necessary to the nail polish removal process, but, nonetheless, may prove desirable for commercial, aesthetic, or other reasons.

Assembly of the kit consists in inserting the cylindrical, sponge-like filler 14 vertically into the jar so that the opening 34 is in a vertical position; then the nail polish remover solution is added; then the dauber is inserted so that the lateral projection 40 rests on the upper surface 42 of the filler; the cap liner is inserted in the cap; and the cap placed open end down onto the neck of the jar and turned in a clockwise direction until the lid engagingly seals the jar. Alternative, but less preferred, methods of assembly are also available. For example, the nail polish removal solution may be added to the jar prior to insertion of the filler. Additionally, the dauber may be inserted in the filler prior to insertion of the filler in the jar.

In operation, the user will grab onto the jar with one hand and the jar lid with the other, and will then disengage the lid by turning it in a counter-clockwise direction and then lifting it from the jar. Although the user could continue to hold the lid with one hand and use the other to remove the dauber, the preferred method is to rest the lid on a table or other object to free that hand. The dauber handle may be grasped with either hand and the dauber removed. The dauber's absorbent end, which is saturated with the nail polish remover solution, is then rubbed across the polished nail such as finger -or toenail from which the polish is to be removed. Some slight force may be desired. The polish will be transferred from the nail to the dauber, so that periodically the dauber should be re-inserted in the filler to allow the solvent therein to remove the nail polish from the dauber. As the dauber is being removed, the friction caused due to the fact that the filler opening is smaller than the diameter of the dauber will cause the excess solvent to be removed from the dauber, thereby eliminating solvent drippage from the dauber which may be harmful to furniture, clothing, and the like, or be otherwise objectionable. Although the dauber was designed primarily to facilitate removing polish from teonails, since it would be difficult to insert a toe into the filler, the dauber may be used to remove nail polish from any surface upon which nail polish remover may be used, such as toenails or fingernails.

Figure 3:
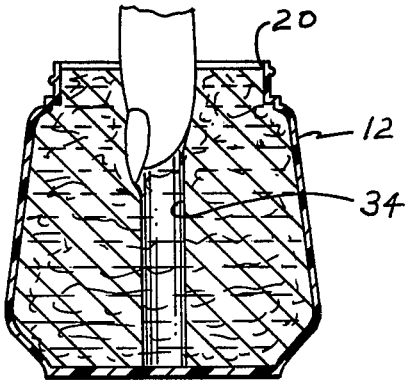
FIG. 3 is a sectional view of the kit with the lid removed, which shows an inserted finger replacing the dauber.
Figure 4:
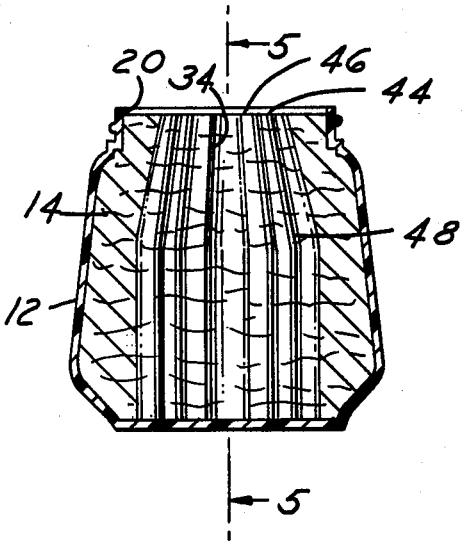
FIG. 4 is a sectional view of the kit with the lid and dauberremoved, which shows a modified form of the finger receiving opening with partially corrugated surfaces.
Figure 6:
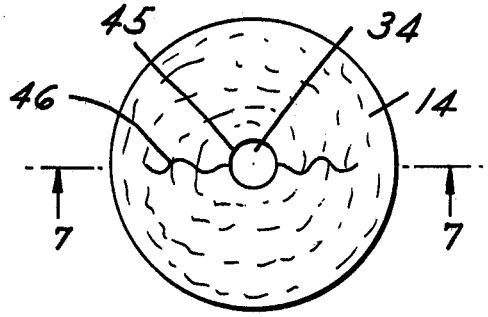
FIG. 6 is a top view of the kit of FIG. 4 showing a finger receiving opening which is partially corrugated and partially noncorrugated.
Figure 5:
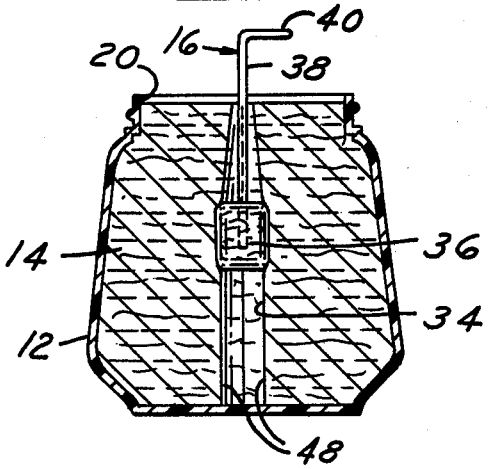
FIG. 5 is a plan view of the kit taken along lines 5—5 of FIG. 4, and shows a noncorrugated portion of the finger receiving opening.
Figure 7:
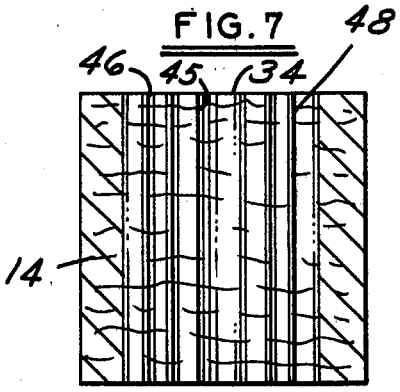
FIG. 7 is a view of a surface of the finger receiving opening of the modification shown in FIG. 4.

An alternative method for removing nail polish from fingernails is to first remove the dauber to free the filler opening. The dauber may be placed in any desirable spot, preferably the inside of the cap, so that it will not interfere with the next step. This next step entails inserting the finger containing the nail from which the polish is to be removed into the filler opening as shown in FIG. 3. The finger should be inserted so that the tip of the finger extends towards the lower portion of the jar but not so far that it engages the sludge at the bottom. For this purpose, it has been found that the nine-ounce jar preferred by this invention allows sufficient clearance. The finger may then be rotated within the opening, exposing the polished nail to the solvent and the abrasive wiping action of the filler material. After sufficient contact, the finger is retracted. As it is retracted, excess solvent is wiped from the finger and nail so that the solvent that remains evaporates rapidly from the finger when withdrawn without leaving any noticaeable residue on the finger after drying.

When using kits with a finger receiving opening 34 having corrugated surfaces 46 in part or in whole, the nail containing finger may be inserted into the finger receiving opening 34 and moved across a corrugated surface. Preferably, the nail will be removed across the surface in such a manner that an undulation will be experienced, although this is not necessary. As described above, the finger may be rotated within the opening, exposing the polished nail to the solvent and the abrasive wiping action of the filler material. And each of these cleaning actions, vertical, lateral, rotational and the like may be done independently or with varying degrees of interdependence. After sufficient contact, the finger is retracted. As it is retracted, excess solvent is wiped from the finger and nail so that the solvent that remains evaporates readily from the finger when withdrawn without leaving any noticeable residue on the finger after drying.

When all the nail polish has been removed, the dauber is preferably re-inserted in the filler opening so that the dauber projection rests on top of the filler, the lid is placed open end down onto the neck of the jar and turned in a clockwise direction until engagingly secured.

Tests show that, for a kit utilizing a nine-ounce jar herein disclosed, approximately 80 usages are reasonable, wherein each use would include doing all the fingernails. Furthermore, tests show that with the nine-ounce polypropylene jar using the disclosed sealed cap, acetone and water, solvent polyester filler and wool dauber, that approximately 6.3% loss of solvent over a one-year period may be expected.

I claim:

1. A nail polish remover kit comprising, in combination:

a jar having walls which rise from a lower portion to an upper portion said upper portion having an upwardly opening constricted mouth;

a lid for removably sealingly closing the mouth;

a sponge-like filler for insertion in the jar having an upper end which prior to insertion is of greater horizontal cross-sectional area than the corresponding upper portion of the jar and after insertion is compressed inwardly by said upper portion of the jar, said filler having a horizontal cross-section below said upper end which, moving from the lower end, and prior to insertion in the jar. progressively increases relative to the corresponding cross-section of the jar, whereby the upper end of the filler is more highly compacted than the lower end of the filler;

said filler having a centrally arranged finger receiving opening at said upper end extending downwardly through the more densely compacted area and sized to wipe a finger inserted therein; and a nail polish remover solution in the jar saturating the filler to wet the nail of a finger inserted in said opening.

2. The invention of claim 1 wherein the sponge is compressed inwardly by the mouth of the jar.

3. The invention of claim 2 further comprising swelling of the filler by the nail polish remover solution to aid in holding the filler in place in the jar.

4. The invention of claim 2 wherein the jar is pear shaped.

5. The invention defined by claim 2 characterized by a dauber having an enlarged absorbent end and a narrow handle portion received absorbent-end-first into said opening with the handle portion disposed to be grasped at the mouth of the jar.

6. The invention defined by claim 2 wherein said jar has a side wall diverging outwardly upwardly from the base and thereafter converging upwardly to said constricted mouth; and said filler is substantially uncompressed by the side wall adjacent the base of the jar and progressively compressed therefrom toward the mouth of the jar.

7. The invention defined by claim 2 wherein the nail polish remover solution consists essentially of water and acetone in ranges of 86% to 100% acetone.

8. The invention defined by claim 2 wherein the spongelike filler is compressed inwardly by the constricted mouth to increase the capillarity of the filler.

9. The invention defined by claim 2 wherein the finger receiving opening has a diameter lying in the range of from $\frac{1}{4}$ inch to $\frac{1}{2}$ inches.

10. The invention defined by claim 9 wherein the finger receiving opening extends the entire vertical length of the filler.

11. The invention defined by claim 5 wherein the absorbent end of the dauber is comprised of wool.

12. The invention of claim 2 wherein at least a portion of the surface of the filler defining the finger receiving opening is uneven.

13. The invention of claim 2 wherein at least a portion of the surface of the filler defining the finger receiving opening is corrugated.

14. The invention of claim 13 wherein at least a portion of the surface of the filler defining the finger receiving opening is laterally corrugated.

15. The invention of claim 13 wherein at least a portion of the surface of the filler defining the finger receiving opening is vertically corrugated.

16. The method of removing nail polish comprising the steps of inserting a fingernail coated with nail polish into the finger receiving opening of claim 2; and moving the fingernail within the finger receiving opening against a surface, whereby removal of the nail polish is effectuated.

17. The method of removing nail polish comprising the steps of inserting a fingernail coated with nail polish into the finger receiving opening of claim 11; and moving the fingernail within the finger receiving opening and against a surface thereof, whereby removal of the nail polish is effectuated.

18. The method of claim 10 wherein the fingernail is moved laterally across a laterally corrugated surface of the finger receiving opening.

* * * * *

UNITED STATES PATENT AND TRADEMARK OFFICE

CERTIFICATE OF CORRECTION

PATENT NO. : 4,440,181

DATED : April 3, 1984

INVENTOR(S) : John S. Scherer

It is certified that error appears in the above-identified patent and that said Letters Patent is hereby corrected as shown below:

Col. 7, claim 1, line 11, change the period after "jar" to a comma.

Col. 8, claim 17, line 35, "claim 11" should read -- claim 14 --

Col. 8, claim 18, line 39, "claim 10" should read -- claim 16 --.

Signed and Sealed this

*Nineteenth* Day of *June 1984*

[SEAL]

*Attest:*

GERALD J. MOSSINGHOFF

*Attesting Officer*

*Commissioner of Patents and Trademarks*